US006810949B1

(12) United States Patent
Staffa et al.

(10) Patent No.: US 6,810,949 B1
(45) Date of Patent: Nov. 2, 2004

(54) MULTIBLOCK HEAT-TRANSFER SYSTEM

(75) Inventors: Karl-Heinz Staffa, Stuttgart (DE); Hans-Joachim Krauss, Stuttgart (DE); Hagen Mittelstrass, Bondorf (DE); Christoph Walter, Stuttgart (DE); Bernd Dienhart, Cologne (DE); Jochen Schumm, Eberdingen (DE)

(73) Assignee: BEHR GmbH & Co., Stuttgart (DE)

( * ) Notice: Subject to any disclaimer, the term of this patent is extended or adjusted under 35 U.S.C. 154(b) by 0 days.

(21) Appl. No.: 09/958,090

(22) PCT Filed: Mar. 7, 2000

(86) PCT No.: PCT/EP00/01966

§ 371 (c)(1),
(2), (4) Date: Jan. 7, 2002

(87) PCT Pub. No.: WO00/60298

PCT Pub. Date: Oct. 12, 2000

(30) Foreign Application Priority Data

Apr. 6, 1999 (DE) ..... 199 15 389

(51) Int. Cl.[7] ..... F28F 13/00
(52) U.S. Cl. ..... 165/135; 165/144; 165/150; 165/173; 165/175; 165/178
(58) Field of Search ..... 165/144, 173, 165/175, 150

(56) References Cited

U.S. PATENT DOCUMENTS

| | | | | | |
|---|---|---|---|---|---|
| 4,386,652 | A | * | 6/1983 | Dragojevic et al. | 165/144 |
| 4,770,240 | A | * | 9/1988 | Dawson et al. | 165/176 |
| 4,917,180 | A | * | 4/1990 | Wolf et al. | 165/150 |
| 5,025,855 | A | * | 6/1991 | Hoshino et al. | 165/150 |
| 5,052,477 | A | * | 10/1991 | Nakajima et al. | 165/153 |
| 5,076,353 | A | | 12/1991 | Haussman | 165/110 |
| 5,086,835 | A | * | 2/1992 | Shinmura | 165/144 |
| 5,090,477 | A | * | 2/1992 | Sprow et al. | 165/150 |
| 5,095,972 | A | * | 3/1992 | Nakaguro | 165/153 |
| 5,101,890 | A | * | 4/1992 | Aoki et al. | 165/152 |
| 5,190,100 | A | * | 3/1993 | Hoshino et al. | 165/146 |
| 5,197,538 | A | * | 3/1993 | Nagasaka et al. | 165/144 |
| 5,246,064 | A | * | 9/1993 | Hoshino et al. | 165/146 |
| 5,348,081 | A | * | 9/1994 | Halstead et al. | 165/144 |
| 5,458,190 | A | * | 10/1995 | Sasaki et al. | 165/110 |
| 5,482,112 | A | * | 1/1996 | Sasaki et al. | 165/110 |
| 5,529,116 | A | * | 6/1996 | Sasaki et al. | 165/144 |

(List continued on next page.)

FOREIGN PATENT DOCUMENTS

| | | |
|---|---|---|
| DE | 33 44 220 | 6/1985 |
| DE | 39 18 455 | 12/1990 |
| DE | 195 09 654 | 9/1996 |
| DE | 195 36 116 | 4/1997 |
| DE | 43 27 213 | 12/1997 |
| EP | 0 361 358 | 4/1900 |
| EP | 0 367 078 | 3/1993 |
| EP | 0 431 917 | 5/1994 |
| FR | 2 676 273 | 11/1992 |
| WO | 98/51983 | 11/1998 |

*Primary Examiner*—Henry Bennett
*Assistant Examiner*—Nihir Patel
(74) *Attorney, Agent, or Firm*—Foley & Lardner LLP

(57) ABSTRACT

A multiblock heat-transfer system including a first heat-transfer unit and at least a second heat transfer unit mounted onto the first heat-transfer unit. The first heat transfer unit contains a first heat-transfer tubular block with at least a first collecting chamber at the side. The second heat-transfer unit contains a second heat-transfer tubular block with at least a second collecting chamber at the side. The first and second collecting chamber each consist of their own collecting pipe, and both collecting pipes are inserted into each other at their front faces and are connected in a fluid-tight manner. In the pipe connection area, the external diameter of one of the collecting pipes approximately matches the internal diameter of the other collecting pipe, and a transverse partition is provided for separating the two collecting chambers.

9 Claims, 3 Drawing Sheets

U.S. PATENT DOCUMENTS

Figure 1:
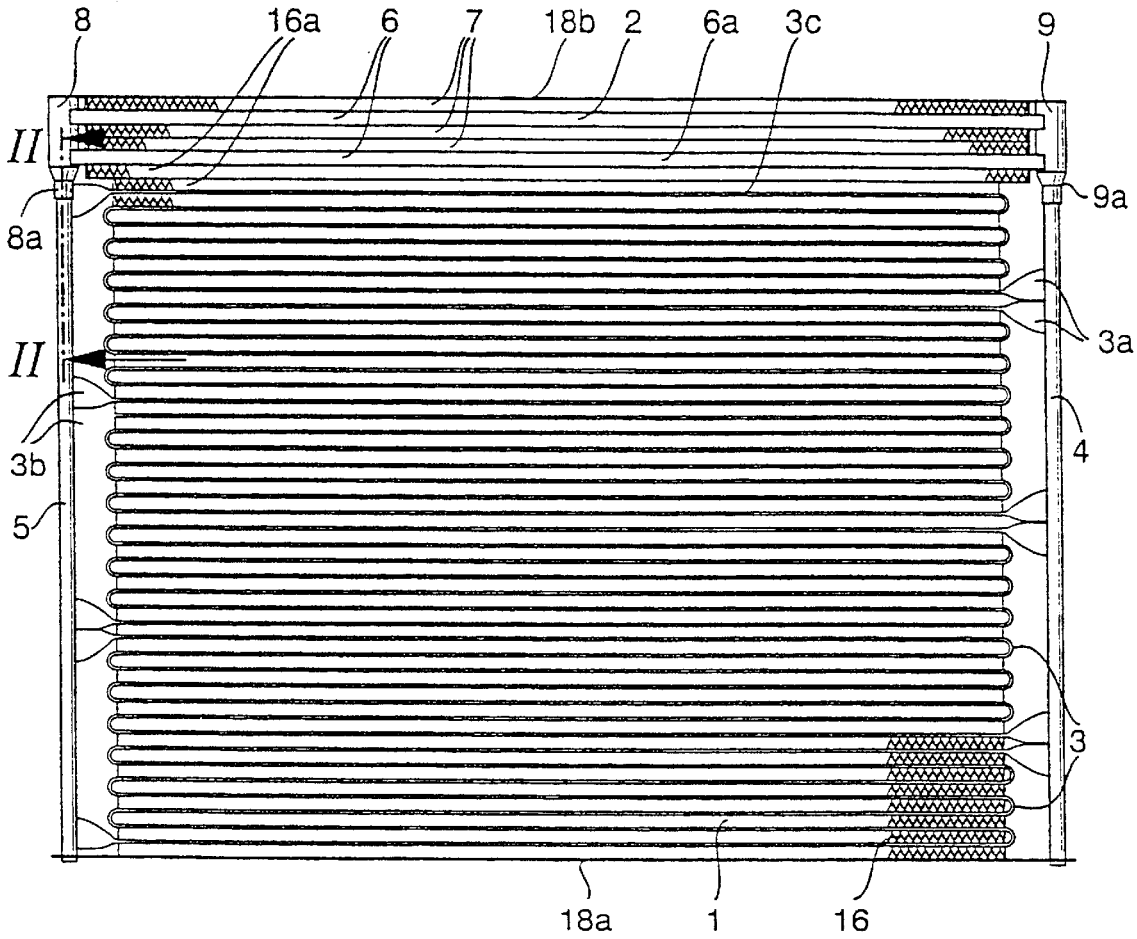

RE35,655 E * 11/1997 Hoshino et al. ..... 165/146
RE35,711 E * 1/1998 Hoshino et al. ..... 165/146
RE35,742 E * 3/1998 Hoshino et al. ..... 165/150
5,743,328 A * 4/1998 Sasaki et al. ..... 165/144
5,765,393 A * 6/1998 Shlak et al. ..... 62/507
5,826,649 A * 10/1998 Chapp et al. ..... 165/174
5,988,267 A * 11/1999 Park et al. ..... 165/110
6,021,846 A * 2/2000 Sasaki et al. ..... 165/144
6,073,686 A * 6/2000 Park et al. ..... 165/144
6,155,340 A * 12/2000 Folkedal et al. ..... 165/175
6,182,744 B1 * 2/2001 Nakamura et al. ..... 165/140
6,189,604 B1 * 2/2001 Yamauchi et al. ..... 165/140
6,305,465 B1 * 10/2001 Uchikawa et al. ..... 165/140
6,523,606 B1 * 2/2003 Dienhart et al. ..... 165/144

* cited by examiner

MULTIBLOCK HEAT-TRANSFER SYSTEM

The invention relates to a multi-block heat exchanger with a first heat exchanger unit and at least one second heat exchanger unit attached to the first heat exchanger unit. The first heat exchanger unit includes a first heat exchanger block of pipes having at least one first lateral collecting chamber. The second heat exchanger unit includes a second heat exchanger block of pipes having at least one second lateral collecting chamber. In a heat exchanger of this type, the two or more heat exchanger units are integrated into a common constructional unit. The individual heat exchanger units each contain a block of heat exchanger pipes and can have different heat exchanger media flowing through them in order to bring said media into thermal contact, for example, with an air flow guided away over the blocks of pipes on the outside of the pipes. A multi-block heat exchanger of this type is suitable, for example, as a combined oil cooler and condenser/gas cooler in motor vehicles. With the oil-cooler heat exchanger unit, operating oil, for example of a motor vehicle transmission, which is circulating in an oil circuit can be cooled, while in the condenser or gas-cooler heat exchanger unit a high-pressure refrigerant of a motor vehicle air conditioning system can be condensed or cooled.

It is known, for example from laid-open specifications EP 0 367 078 A1 and EP 0 431 917 A1, to integrate two heat exchanger units having a respective block of flat pipes in a common constructional unit by the two blocks of flat pipes together with the associated, lateral collecting pipes being arranged lying one behind the other in the downward direction of the blocks and being connected to each other by a common, heat-conducting corrugated rib structure.

In the case of a multi-block heat exchanger disclosed in laid-open specification DE 33 44 220 A1, there is accommodated in a lateral cutout of a first block of pipes of a first heat exchanger unit, between lateral connecting tanks thereof, a second block of pipes together with lateral connecting tanks of a further heat exchanger unit, the second block of pipes being welded onto an adjacent closing wall of the first block of pipes.

Laid-open specification DE 195 36 116 A1 describes a heat exchanger, in which a block of pipes/ribs together with two lateral collecting pipes is divided into two regions for different heat exchanger media by the two collecting pipes being subdivided at corresponding points by a transverse partition arrangement into two separate collecting chambers in each case which are assigned dedicated connection structures. At the height of this separating region, instead of the flat pipes which are otherwise provided, a separating web is fitted into the block of pipes/ribs.

The technical problem on which the invention is based is the provision of a multi-block heat exchanger of the type mentioned at the beginning, in which, with relatively little outlay, at least one further heat exchanger unit of flexible construction is attached to a first heat exchanger unit in a largely isolated manner thermally.

According to an embodiment of the present invention, the invention solves this problem by the provision of a multi-block heat exchanger having a first heat exchanger unit and at least one second heat exchanger unit attached to the first heat exchanger unit. The first heat exchanger unit includes a first heat exchanger block of pipes having at least one first lateral collecting chamber. The second heat exchanger unit includes a second heat exchanger block of pipes having at least one second lateral collecting chamber. The first and second collecting chambers are formed by a dedicated collecting pipe in each case. The two collecting pipes are fitted one into the other on end sides of the collecting pipes and are connected in a fluid tight manner. An outer cross section of one collecting pipe in the pipe-connecting region essentially corresponds to an inner cross section of the other collecting pipe. A transverse partition is provided to separate the two collecting chambers. Thus, in the case of this heat exchanger, the blocks of pipes of the different heat exchanger units are provided with dedicated collecting pipes in each case, which makes possible, in particular, the use of collecting pipes having cross sections differing in size for the individual blocks of pipes. Every two heat exchanger units are connected to each other at least via a collecting-pipe connection on the end side by the two collecting pipes which are involved being fitted one into the other on their end sides and being connected in a fluid-tight manner. For this purpose, the collecting pipes are designed in this end-side region in such a manner that the outer cross section of the inserted collecting pipe essentially corresponds to the inner cross section of the collecting pipe fitting around it. A transverse partition provided in the pipe-connecting region keeps the collecting chambers belonging to the two collecting pipes separate from each other. This type of integration of two or more heat exchanger units into a common constructional unit has the advantage of enabling different heat exchanger units to be assembled in a flexible manner to form a multi-block heat exchanger, i.e. various different heat exchanger units can optionally be attached to a given, first heat exchanger unit.

According to another embodiment of the present invention, a multi-block heat exchanger is provided. This embodiment is similar to the first embodiment except that the outer collecting pipe in the pipe-connecting region tapers from a larger central-region cross section to a smaller connecting-region cross section. Additionally, the outer collecting pipe is manufactured by a drawing-in, hammering or expansion process or as an extruded part. Thus, the two collecting pipes of two assembled heat exchanger units have cross sections which differ in size in their central region into which the pipes of the associated block of pipes lead in each case. In order to realize the collecting-pipe connection, the collecting pipe having the larger central-region cross section is tapered in the corresponding end-side connecting region to a smaller cross section which is then just sufficient in order to accommodate the collecting pipe having the smaller cross section. The collecting pipe which is tapered on the end side is manufactured with relatively little outlay by a drawing-in, hammering or expansion process or as an extruded part.

According to another embodiment of the present invention, a multi-block heat exchanger is provided. This embodiment is similar to the first embodiment except that in the pipe-connecting region the outer collecting pipe is solder-plated on its inside or the inner collecting pipe is solder-plated on its outside. Thus, in the pipe-connecting region of the two collecting pipes fitted together the outer collecting pipe is solder-plated on its inside and/or the inner collecting pipe is solder-plated on its outside. This measure enables the two collecting pipes to be connected in a soldering procedure in which the leakproof soldering of the heat exchanger pipes to the collecting pipes and the soldering of heat-conducting ribs, if provided, to the heat exchanger pipes preferably take place at the same time.

According to another embodiment of the present invention, a heat exchanger is provided. This embodiment is similar to the first embodiment except that the two blocks of pipes are arranged lying next to each other in a vertical direction of the blocks. Additionally, there are at least two heat-conducting ribs and/or an air gap and/or a thermally insulating block-closing wall between the heat exchanger pipe of the one block of pipes and the heat exchanger pipe of the other block of pipes that are closest together. Thus, the heat exchanger contains at least two blocks of pipes which are arranged lying next to each other in the vertical direction of the blocks. There are at least two heat-conducting ribs and/or an air gap and/or a thermally insulated block-closing wall between those pipes of the respective block of pipes which lie opposite one another and are in each case the last ones on this side, with the result that these two heat exchanger pipes can, if required, be decoupled thermally from each other to the greatest extent.

According to another embodiment of the present invention, a heat exchanger is provided. This embodiment is similar to the first embodiment except the two blocks of pipes are arranged offset in a downward direction of the blocks. Additionally, one of the two collecting pipes includes a U-bend via which it is guided from the plan of its associated block of pipes to the pipe-connecting region in the plane of the other block of pipes. Thus, at least two heat exchanger units having blocks of pipes offset in the downward direction of the blocks, i.e. in the direction perpendicular with respect to the planes of the blocks of pipes, are provided. In order to realize the end-side collecting-pipe connection of the two heat exchanger units, a collecting pipe of the one heat exchanger unit is provided with a U-bend via which it is guided from the plane of its associated block of pipes into the plane of the other block of pipes, which plane is offset with respect thereto and in which the collecting pipe, which is connected to said U-bend, of the other block of pipes lies. Consequently, by means of this measure a plurality of independent heat exchanger blocks of pipes can be decoupled thermally to the greatest possible extent and, in particular, can be arranged offset in the downward direction of the blocks in a common constructional unit without a common heat-conducting rib connection and without any other common connection of the elements of the blocks of pipes. In the case of a block of pipes through which, for example, air flows on the outside of the pipes, the downward direction of the blocks is parallel in this case to the direction of flow of the medium guided past on the outside of the pipes.

According to another embodiment of the present invention, a multi-block heat exchanger is provided. This embodiment is similar to the first embodiment except that the heat exchanger includes at least two further heat exchanger units having a respective block of pipes and lateral collecting pipes. The two further heat exchanger units are attached to the first heat exchanger unit. The further heat exchanger units are arranged lying opposite one another along an inner collecting-chamber side and adjacent in a vertical direction of the blocks of the first heat exchanger unit. Additionally, an associated outer collecting pipe in each case is connected on an end side to a collecting pipe of the first heat exchanger. Thus, the heat exchanger of this embodiment contains at least three heat exchanger units having associated blocks of pipes, there being arranged on the same side of a first heat exchanger unit two further heat exchanger units lying next to each other in the longitudinal direction of the heat exchanger pipes. The overall width of the two further heat exchanger units, which width is determined essentially by the overall length of the heat exchanger pipes, is preferably selected in such a manner that it corresponds approximately to the width of the third heat exchanger unit, resulting altogether in the formation of a constructional unit having dimensions which remain approximately the same over the regions of the different heat exchanger units. This also facilitates the connection of one collecting pipe in each case of the two further heat exchanger units to a collecting pipe of the first heat exchanger unit, since in this case the collecting pipes which are connected to one another lie largely coaxially with one another. In a further refinement of this heat exchanger, the two further heat exchanger units include a joint, inner, two-channel collecting pipe that has two collecting chambers separated by a longitudinal partition. Thus, the two mutually facing collecting chambers of the two further heat exchanger units are integrated in a compact manner into a common collecting pipe having a corresponding longitudinal partition.

According to another embodiment of the present invention, a multiblock heat exchanger is provided. This embodiment is similar to the first embodiment except the block of pipes of the first heat exchanger unit is formed by flat pipes that are fitted with twisted ends into lateral collecting pipes having an inner diameter that is smaller than the width of the flat pipes. Thus, the cross section of the collecting pipe of at least one of the heat exchanger units is selected such that it is smaller than the width of the flat pipes used for constructing the associated block of pipes. Said flat pipes lead on the underside with twisted end regions into the collecting pipe which is kept relatively thin and can then be fitted on the end side into a collecting pipe of larger cross section of an adjacent heat exchanger unit. Heat exchanger units having such thin collecting pipes are suitable particularly for air conditioning systems having high operating pressures, such as $CO_2$ air conditioning systems.

Figure 2:
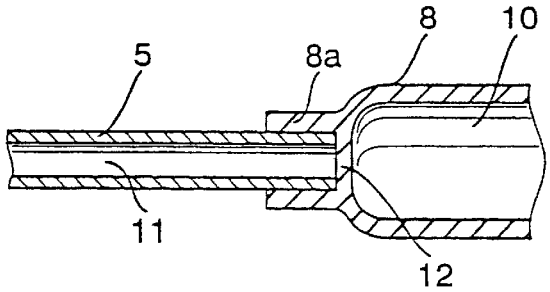
Figure 3:
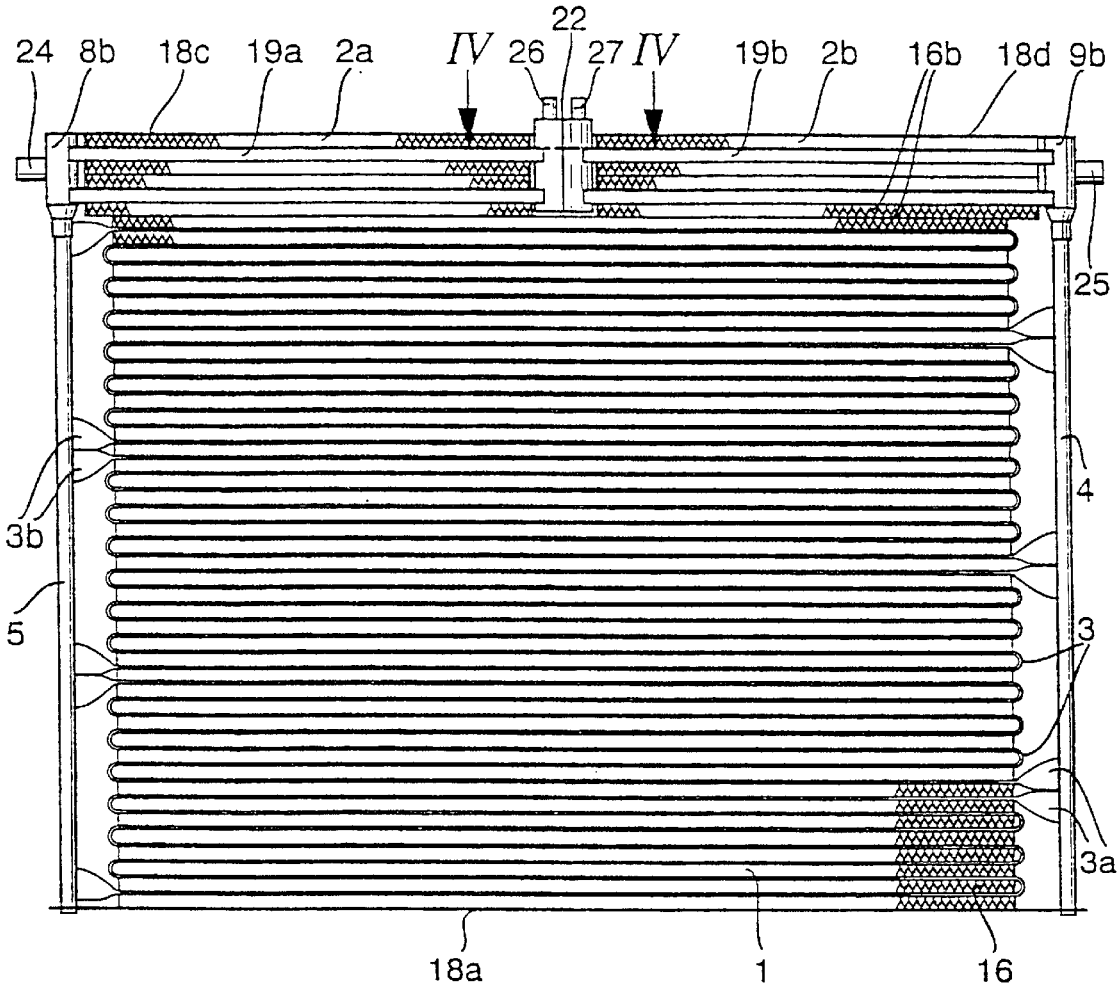
Figure 4:
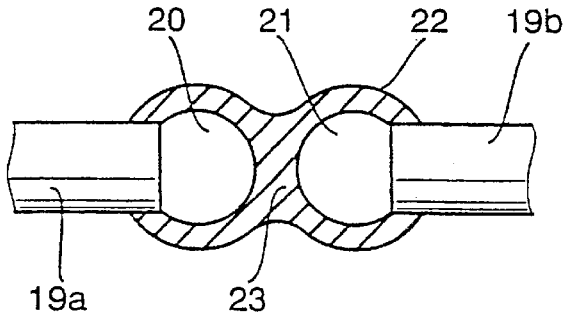
Figure 5:
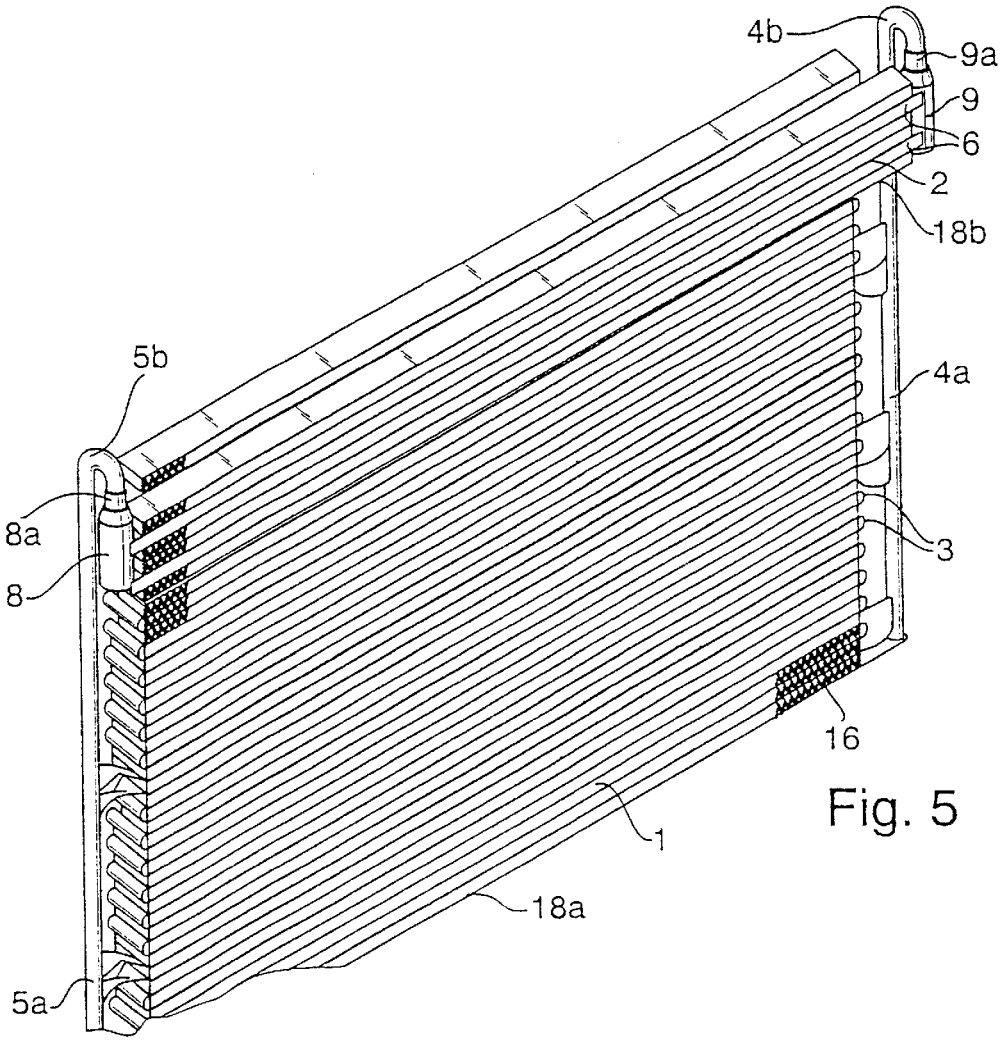
Figure 6:
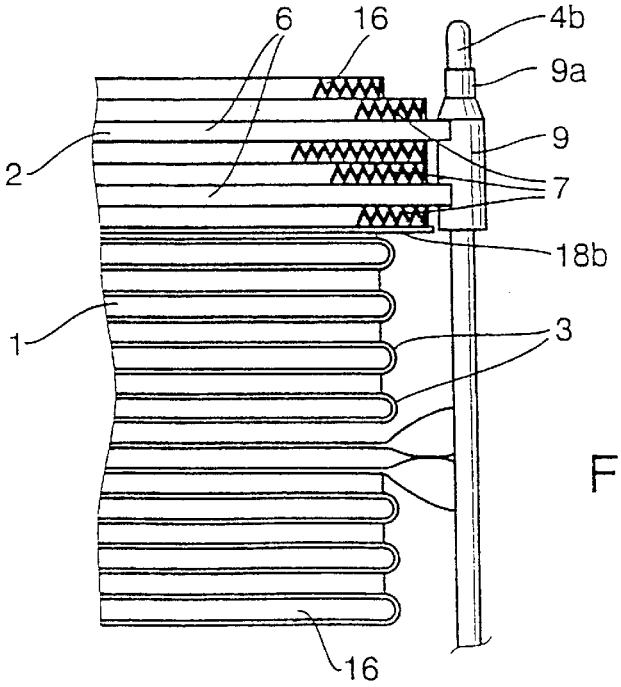

Advantageous embodiments of the invention are illustrated in the drawings and are described below. In this case:

FIG. 1 shows a side view of a two-block heat exchanger having blocks of pipes lying next to each other and collecting pipes connected on the end side, FIG. 2 shows a longitudinal sectional view along the line II—II from FIG. 1, FIG. 3 shows a side view of a three-block heat exchanger having two smaller blocks of pipes which are adjacent to each other on the collecting-chamber side and are arranged on one side of a larger block of pipes, FIG. 4 shows a cross-sectional view of a common, inner collecting pipe of the two blocks of pipes which are adjacent to each other on the collecting-chamber side, from FIG. 3, FIG. 5 shows a perspective view of a two-block heat exchanger having blocks of pipes which are arranged offset in the downward direction of the blocks, and FIG. 6 shows part of a side view of the two-block heat exchanger from FIG. 5.

In the two-block heat exchanger shown in FIG. 1, two heat exchanger units having blocks of pipes/ribs 1, 2 lying next to one another in the vertical direction of the blocks are integrated to form a common constructional unit. The block of pipes/ribs 1 belonging to the one, first heat exchanger unit comprises a plurality of serpentine flat pipes 3 which are consecutive in the vertical direction of the blocks. Furthermore, this heat exchanger unit has two collecting pipes 4, 5 which extend in the vertical direction of the blocks along opposite block sides. Each flat pipe 3 leads with a respective end region 3*a*, 3*b* into the two collecting pipes 4, 5, one of which therefore serves, depending on the direction of flow, for the parallel distribution of a supplied heat transfer medium to the various serpentine flat pipes 3, and the other of which serves for collecting this heat transfer medium when it emerges from the serpentine flat pipes. In this case, the serpentine flat pipes 3 are in each case placed next to one another with inlet-side regions facing one another and outlet-side regions facing one another, in order to avoid undesirable heat transfer effects between an inlet-side region of the one serpentine flat pipe 3 and an outlet-side region of the adjacent serpentine flat pipe 3. In the same manner as between the individual turns of each serpentine flat pipe 3, heat-conductive corrugated ribs 16 are placed between adjacent serpentine flat pipes 3. In this connection, for the sake of clarity, only a small portion of the diverse corrugated ribs are explicitly reproduced in FIG. 1 and in FIGS. 3, 5 and 6.

The two collecting pipes 4, 5 of this first heat exchanger unit are manufactured with a relatively small outside diameter which, in particular, is smaller than the width of the serpentine flat pipes 3 which are used. For this reason, the flat pipe ends 3*a*, 3*b* are fitted into the collecting pipes 4, 5 in a manner twisted through 90° with respect to the flat-pipe central region about the flat-pipe longitudinal axis.

The block 2 of pipe/ribs of the other heat exchanger unit is constructed from rectilinear flat pipes 6, a respective heat-conducting corrugated rib 7 being provided on both sides of each rectilinear flat pipe 6. The rectilinear flat pipes 6 lead in turn at opposite block sides into a respective collecting pipe 8, 9 situated there. In contrast to the collecting pipes of the other heat exchanger unit, these two collecting pipes 8, 9 have a larger outside and inside diameter, the inside diameter being selected, in particular, such that it is of a sufficient size that the rectilinear flat pipes 6 are fitted, with non-twisted ends which run transversely with respect to the longitudinal axis of the collecting pipes, into corresponding transverse slots of the collecting pipes 8, 9.

The two blocks 1, 2 of pipes/ribs are arranged in such a manner, forming a common, compact constructional unit, that the rectilinear flat pipes 6 run parallel to the rectilinear sections of the serpentine flat pipes 3 and the two heat-exchanger pipe sections 6*a*, 3*c* which are closest to each other of the two blocks 1, 2 are spaced apart from each other by two rows 16*a* of corrugated ribs which, if required, can be decoupled to the greatest possible extent thermally from one another by, for example, an air gap, with the result that no noticeable transfer of heat from the one block of pipes to the other occurs. At the two transverse sides running parallel to the rectilinear flat-pipe regions the two blocks 1, 2 of pipes/ribs are closed by a respective, associated closing wall 18*a*, 18*b*.

The two heat exchanger units are attached to each other primarily by their respective collecting pipes 4, 5, 8, 9 on the same side being fitted one into another and by them being connected to one another in a gas-tight manner by soldering or welding. An additional fixing of the two blocks 1, 2 of pipes/ribs to each other can therefore be omitted, when required, which additionally facilitates the thermal decoupling of the two blocks 1, 2. In order to bring about said collecting-pipe connections, the two collecting pipes 8, 9 of large diameter of the one heat exchanger unit are tapered in their corresponding, end-side pipe-connecting region.

These tapering collecting pipes 8, 9 can be manufactured by a drawing-in, hammering or expansion process, or these collecting pipes 8, 9 can be manufactured as an extruded part, as is assumed in the sectional illustration of FIG. 2. As can be seen more precisely from FIG. 2, the collecting pipe 8 concerned tapers from its central region of large cross section, which defines an associated collecting chamber 10, to an end-region 8*a* of smaller cross section in such a manner that the inside diameter of the tapered end region 8*a* correspond approximately to the outside diameter of the thinner collecting pipe 5, which is inserted therein on the end side, of the other heat exchanger unit. The collecting chamber 11, which is defined by the thinner collecting pipe 5, i.e. the pipe with the smaller diameter, is separated from the collecting chamber 10 of the other collecting pipe 8 by a transverse partition 12 which is formed by a base of the collecting pipe 8, which is of larger diameter, in the transitional region from its large cross section to the tapered end 8*a*.

The multi-block heat exchanger of FIG. 1 can be used, in particular, as a combined oil-cooler or gas-cooler/condenser heat exchanger in motor vehicles. When used in this manner, the heat exchanger unit having the flat-pipe serpentine block 1 forms a condenser or gas cooler for condensing or cooling a high-pressure flow of refrigerant of an air conditioning system, while the other heat exchanger unit having the block 1 of pipes comprising rectilinear flat pipes forms an oil cooler for cooling an operating oil of the motor vehicle, which oil is circulating in an oil circuit, for example in a transmission-oil or servo-oil circuit. In line with this application, the oil-cooler collecting pipes 8, 9 are configured with a larger cross section than the refrigerant collecting pipes 4, 5. The last-mentioned collecting pipes 4, 5 thereby define a relatively small collecting-chamber volume, as is desirable for a condenser or gas cooler, in particular when carbon dioxide is used as refrigerant. When this refrigerant is used, the selection of a relatively small diameter for the associated collecting pipes 4, 5 also has the advantage that they can be configured to be very stable to compression while having a comparable wall thickness to the two other collecting pipes 8, 9, with the result that they withstand without any problem the pressures typically occurring on the high-pressure side of $CO_2$ air conditioning systems.

The assembly of the two heat exchanger units to form the common constructional unit can take place firstly by the two heat exchanger units, i.e. the respective block 1, 2 of pipes/ribs having the associated, lateral collecting pipes 4, 5, 8, 9, being first of all constructed and soldered separately and then the two premanufactured heat exchanger units being fixed to each other by fitting the collecting pipes 4, 9 and 5, 8 which are on the same side one into the other and securely connecting them, for example by a soldering or welding procedure. As an alternative, the entire constructional unit comprising the two heat exchanger units can be constructed together and subsequently soldered or welded in a single soldering or welding process. In this connection, it is of advantage if in the collecting-pipe connecting region the inside of the outer collecting pipe 8, 9 and/or the outside of the inner collecting pipe 4, 5 is/are solder-plated, with the result that during the soldering process in a suitable soldering furnace the fixed, end-side connection of the collecting pipes 4, 9 and 5, 8 which are on the same side can also be brought about at the same time by soldering them together.

It goes without saying that the two heat exchanger units which lie next to each other are provided with associated connection structures (not shown) via which the respective heat transfer medium is fed axially or radially into the one collecting pipe and can be removed, in turn axially or radially, from the respective opposite collecting pipe.

FIG. 3 shows a variant of the exemplary embodiment of FIG. 1, which forms a three-block heat exchanger, the same reference numbers being used for functionally identical components and reference can be made in this respect to the above description of FIG. 1. The three-block heat exchanger of FIG. 3 thus contains the same heat exchanger unit having the block 1 of pipes/ribs comprising serpentine-like flat pipes 3 and small-volume, lateral collecting pipes 4, 5, as suitable, for example, as a gas cooler of a $CO_2$ air conditioning system. Instead of the second block 2 of pipes/ribs of FIG. 1, in the case of the heat exchanger unit of FIG. 3 two blocks 2*a*, 2*b* of pipes/ribs are combined with the block 1 of pipes/ribs constructed from the serpentine-like flat pipes 3. In this case, the length of the flat pipes 19*a*, 19*b* used for the two further blocks 2*a*, 2*b* is selected in each case to be approximately half as large as the length of the rectilinear sections of the serpentine flat pipes 3. The two further blocks 2*a*, 2*b* are arranged, on the one hand, in a manner such that they bear against each other along a respective, inner side of the collecting pipes and are arranged, on the other hand, in the vertical direction of the blocks with a side parallel to the extent of the flat pipes, in a manner such that they are in each case adjacent to a common side of the block 1 of serpentine pipes/ribs, with the result that all in all a compact, cuboidal constructional unit having a width which remains approximately the same in the vertical direction of the blocks is produced.

The rectilinear flat pipes 19*a*, 19*b* of the two further, smaller blocks 2*a*, 2*b* of pipes/ribs lead outward into collecting pipes 8*a*, 9*a* which correspond to the corresponding collecting pipes 8, 9 of large diameter from FIG. 1. The rectilinear flat pipes 19*a*, 19*b* on the facing sides of the two smaller blocks 2*a*, 2*b* of pipes/ribs lead inward into two connecting chambers 20, 21 which are situated there and are formed by a common collecting pipe 22, as can be seen from the associated cross-sectional view of FIG. 4. This two-channel collecting pipe 22 can be manufactured, for example, as an extruded pipe and has a central longitudinal partition 23 which divides the interior of the pipe into the two separate collecting chambers 20, 21 running longitudinally.

Each of the two smaller blocks 2*a*, 2*b* of pipes/ribs is connected via its outer collecting pipe 8*a*, 9*a* to the collecting pipe 4, 5, which is on the same side, of the larger heat exchanger unit and consequently together with the block 1 of pipes/ribs thereof to form the common constructional unit. The end-side connections of the collecting pipes 4, 9*a* and 5, 8*a* which are on the same side correspond to those of FIG. 1, to which reference can be made. An additional fixing of the two smaller blocks 2*a*, 2*b* to the larger block 1 can be provided, but only when required, via a connection, which is then preferably configured to be thermally insulating, between the two opposite rows of corrugated ribs 16*b*, for example in the form of a thermally insulating intermediate wall. On the outside which is free in the vertical direction of the blocks, the two smaller blocks 2*a*, 2*b* of pipes/ribs are each provided with a closing wall 18*c*, 18*d*.

As in the example of FIG. 1, in the case of the heat exchanger of FIG. 3 too, the rectilinear flat pipes 19*a*, 19*b* of the two smaller blocks 2*a*, 2*b* are formed with a larger passage cross section than the serpentine flat pipes 3, which makes them suitable in the same manner for use in motor vehicles such that the heat exchanger unit having the block 1 of serpentine flat pipes is used as a condenser or gas cooler, for example of a $CO_2$ air conditioning system, and the two other heat exchanger units having the rectilinear flat pipes 2*a*, 2*b* and the collecting pipes 8*a*, 9*a*, 22 of larger diameter are used as oil coolers, for example the one as a transmission-oil cooler and the other as a servo-oil cooler. For the two smaller heat exchanger units, connection structures in the form of a respective radial connection 24, 25 to the two outer collecting pipes 8*a*, 9*a* and of a respective axial connection 26, 27 to the respective inner collecting chamber 20, 21 are indicated by way of example in FIG. 3.

Otherwise, the advantages and characteristics specified above with regard to the exemplary embodiment of FIG. 1, in particular also as regard the possible production variants, are applicable in an analogous manner for the three-block heat exchanger of FIG. 3.

FIG. 5 illustrates a further variant of the example of FIG. 1, in which functionally identical components are again denoted with the same reference numbers and reference can be made in this respect to the above description of FIG. 1. The exemplary embodiment of FIG. 5, shown with a cut-away corner region there, likewise constitutes a two-block heat exchanger, in which the same two blocks 1, 2 of pipes/ribs as in the example of FIG. 1 are used, but which are not arranged here next to each other in the vertical direction of the blocks, but one behind the other in the downward direction of the blocks, i.e. the smaller block 2 of pipes/ribs having the rectilinear flat pipes 6 lies upstream or downstream of the larger block 1 of pipes/ribs having serpentine flat pipes 3 in the direction of the flow medium, for example air, which is conducted through the two blocks 1, 2 on the outside of the pipes.

The smaller block 2 of pipes/ribs is attached to the larger block 1 of pipes/ribs solely via the two lateral collecting-pipe connections. In this case, the two collecting pipes 8, 9 of larger cross section for the smaller block 2 of pipes/ribs correspond to those of FIG. 1. In contrast, modified collecting pipes 4*a*, 5*a* are used for the serpentine flat-pipe heat exchanger unit, which pipes differ from the two corresponding collecting pipes 4, 5 of the heat exchanger of FIG. 1 by the fact that they are bent over through 180° on the upper side of the block in FIG. 5 to form a U-bend 4*b*, 5*b* in such a manner that its bent over end region comes to lie in each case coaxially with the collecting pipe 8, 9 which is on the same side and is of larger diameter of the smaller block 2 of pipes/ribs and is fitted into its tapered end 8*a*, 9*a* in a fluid-tight manner. Otherwise, the two collecting-pipe connections correspond to those of FIG. 1. The advantages and characteristics mentioned above with regard to the exemplary embodiment of FIG. 1 are otherwise also applicable analogously for the heater exchanger of FIG. 5.

As can be seen in particular from the partial side view of FIG. 6, the smaller block 2 of pipes/ribs which is offset with respect to the larger block 1 of pipes/ribs in the downward direction of the blocks does not protrude beyond the larger block 1 in the vertical direction of the blocks, so that as a result of the coupling-on of the smaller block 2 a constructional space extending beyond the larger block 1 in the plane perpendicular with respect to the downward direction of the blocks is not necessary. In this case, both blocks 1, 2 are exposed on both sides in the vertical direction of the blocks and are provided there on one or both sides, depending on requirements, with associated closing walls; in FIG. 5, for example, are provided on the lower side of the block in each case with the corresponding closing walls 18*a*, 18*b* of FIG. 1.

The exemplary embodiments shown and explained above make it clear that the multi-block heat exchanger according to the invention contains two or more heat exchanger units integrated in a common constructional unit, the heat exchanger units being attached to one another exclusively, or in any case primarily, via end-side connections of associated collecting pipes. This permits a flexible mounting of different, further heat exchanger units onto a first heat exchanger unit in each case. While, in the examples shown, one or two further heat exchanger units are coupled onto a first heat exchanger unit in just one side region, it is, of course, possible to make provision for one or more further heat exchanger units to be coupled in this manner onto two opposite sides of the first heat exchanger unit. In addition, when required, any desired number of heat exchanger units having associated blocks of pipe can be arranged lying next to one another in the vertical direction of the blocks and can be fastened to one another in each case via end-side collecting-pipe connections on the same side and can thereby be connected to form a common, integrated constructional unit.

What is claimed is:

1. A multi-block heat exchanger having a first heat exchanger unit which contains a first heat exchanger block of pipes having at least one first lateral collecting chamber, and at least one second heat exchanger unit which is attached to the first heat exchanger unit and contains a second heat exchanger block of pipes having at least one second lateral collecting chamber, characterized in that the first and the second collecting chambers are formed by a dedicated collecting pipe in each case, and the two collecting pipes are fitted one into the other on their end sides and are connected in a fluid-tight manner, the outer cross section of the one collecting pipe in this pipe-connecting region essentially corresponding to the inner cross section of the other collecting pipe and a transverse partition being provided in order to separate the two collecting chambers.

2. The multi-block heat exchanger as claimed in claim 1, further characterized in that the outer collecting pipe in the pipe-connecting region tapers from a larger central-region cross section to an, in contrast, smaller connecting-region cross section and is manufactured by a drawing-in, hammering or expansion process or as an extruded part.

3. The multi-block heat exchanger as claimed in claim 1, further characterized in that in the pipe-connecting region the outer collecting pipe is solder-plated on its inside or the inner collecting pipe is solder-plated on its outside.

4. The multi-block heat exchanger as claimed in claim 1, further characterized in that the two blocks of pipes are arranged lying next to each other in the vertical direction of the blocks, there being at least two heat-conducting ribs and/or an air gap and/or a thermally insulating block-closing wall between the two heat exchanger pipes which are closest together of the one block of pipes and the other block of pipes.

5. The multi-block heat exchanger as claimed in claim 1, further characterized in that the two blocks of pipes are arranged offset in the downward direction of the blocks, and one of the two collecting pipes is provided with a U-bend via which it is guided from the plane of its associated block of pipes to the pipe-connecting region in the plane of the other block of pipes.

6. The multi-block heat exchanger as claimed in claim 1, further characterized in that at least two further heat exchanger units having a respective block of pipes and lateral collecting pipes are attached to the first heat exchanger unit, said further heat exchanger units being arranged lying opposite one another along an inner collecting-chamber side and adjacent in the vertical direction of the blocks of the first heat exchanger unit, and an associated, outer collecting pipe in each case being connected on the end side to a collecting pipe of the first heat exchanger unit.

7. The multi-block heat exchanger as claimed in claim 6, further characterized in that a joint, inner, two-channel collecting pipe which has two collecting chambers separated by a longitudinal partition is provided for the two further heat exchanger units.

8. The multi-block heat exchanger as claimed in claim 1, further characterized in that the block of pipes of the first heat exchanger unit is formed by flat pipes which are fitted with twisted ends into lateral collecting pipes having an inside diameter which is smaller than the width of the flat pipes.

9. A multi-block heat exchanger, comprising:

a first heat exchanger unit including a first block of pipes and a first collecting pipe;

a second heat exchanger unit configured to be attached to the first heat exchanger unit and including a second block of pipes and a second collecting pipe;

wherein one of the first collecting pipe and the second collecting pipe includes a first connection end having an outer diameter and the other of the first collecting pipe and the second collecting pipe includes a second connection end having an inner diameter substantially corresponding to the outer diameter of the first connection end so that the first connection end can be fitted within the second connection end;

wherein the first and second connection ends are configured to be connected to form a fluid-tight connection; and wherein the connection includes a partition configured to separate a portion of the first collecting pipe from a portion of the second collecting pipe to thereby form a first collecting chamber in the first collecting pipe and a second collecting chamber in the second collecting pipe.

* * * * *